US010823428B2

(12) United States Patent
Jadhav et al.

(10) Patent No.: US 10,823,428 B2
(45) Date of Patent: Nov. 3, 2020

(54) VERTICALLY TRANSLATING HINGE MECHANISM FOR A BUILT-IN OVEN

(71) Applicant: WHIRLPOOL CORPORATION, Benton Harbor, MI (US)

(72) Inventors: Tushar Jadhav, Pune (IN); Sachin Karade, Pune (IN); Atul Nalawade, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 488 days.

(21) Appl. No.: 15/147,339

(22) Filed: May 5, 2016

(65) Prior Publication Data

US 2017/0321903 A1 Nov. 9, 2017

(51) Int. Cl.

| | |
|---|---|
| ***F24C 15/02*** | (2006.01) |
| ***E05F 15/53*** | (2015.01) |
| ***E05D 15/46*** | (2006.01) |
| ***E05F 15/611*** | (2015.01) |
| ***E05F 17/00*** | (2006.01) |
| ***E05F 1/10*** | (2006.01) |

(52) U.S. Cl.

CPC ..... *F24C 15/023* (2013.01); *E05D 15/46* (2013.01); *E05F 1/10* (2013.01); *E05F 15/53* (2015.01); *E05F 15/611* (2015.01); *E05F 17/004* (2013.01); *E05F 2017/008* (2013.01); *E05Y 2900/308* (2013.01)

(58) Field of Classification Search

CPC .... A47L 15/4261; F24C 15/02; F24C 15/023; E05D 3/14; E05D 3/16; E05D 3/18; E05D 15/46; E05D 15/53; E05D 15/63; E05D 15/611; E05D 15/649; E05D 15/678; E05F 11/16; E05F 11/18; E05F 11/24; E05F 11/26; E05F 15/53; E05F 15/611; E05F 17/004; E05Y 2900/308

See application file for complete search history.

(56) References Cited

U.S. PATENT DOCUMENTS 1,072,809 A * 9/1913 Baxter ..... E05F 17/004 126/191
2,879,370 A * 3/1959 Kesling ..... F24C 15/02 126/19 M
2,997,041 A * 8/1961 Wolske ..... F24C 15/022 126/191

(Continued)

FOREIGN PATENT DOCUMENTS

GB 824780 A * 12/1959 ..... B60J 5/0497
WO WO-8604978 A1 * 8/1986 ..... F24C 15/023

(Continued)

*Primary Examiner* — Daniel J Troy
*Assistant Examiner* — Ryan A Doyle
(74) *Attorney, Agent, or Firm* — Price Heneveld LLP

(57) ABSTRACT

A heating appliance includes an appliance cabinet having a plurality of sidewalls that defining a heating cavity. A door is operably connected to at least one of the sidewalls and operable between open and closed positions. A vertical translating assembly extends from the appliance cabinet to the door. The vertical translating assembly includes drive and offset arms and a power assist mechanism in operable communication with the drive arm. The power assist mechanism at least partially operates the door between the open and closed positions.

17 Claims, 11 Drawing Sheets

(56) References Cited

U.S. PATENT DOCUMENTS 3,059,985 A * 10/1962 Peck ..... F25D 23/021 126/191
3,096,755 A 7/1963 Milburn
3,157,176 A * 11/1964 Pearce ..... F24C 15/022 126/191
3,172,714 A * 3/1965 Kesling ..... F25D 25/021 312/236
3,242,919 A 3/1966 Pearce et al.
3,343,904 A * 9/1967 Laug ..... E06B 3/385 126/191
3,655,942 A * 4/1972 Tomsic ..... A47J 37/0635 219/405
5,806,439 A * 9/1998 Fitts, Sr. ..... G07F 19/205 109/24.1
7,143,548 B2 * 12/2006 Kleinmann ..... B60J 5/106 49/345
7,234,457 B2 * 6/2007 Bartmann ..... E05B 7/00 126/192
7,857,402 B2 12/2010 Anikhindi et al.
7,871,138 B2 1/2011 Anikhindi et al.
8,904,709 B2 12/2014 Ajiki et al.
8,919,338 B2 12/2014 McNamee et al.
9,474,372 B2 * 10/2016 Herper ..... E05D 15/20
2007/0170828 A1 * 7/2007 Hoshide ..... A47B 88/457 312/319.5
2007/0251519 A1 * 11/2007 Anikhindi ..... E05D 15/20 126/194
2009/0321430 A1 * 12/2009 Jeong ..... H05B 6/6414 219/724
2012/0060821 A1 * 3/2012 McNamee ..... E05D 15/46 126/197
2016/0374157 A1 * 12/2016 Ham ..... F24C 15/023

FOREIGN PATENT DOCUMENTS

WO 2009044813 4/2009
WO 2010135531 11/2010

* cited by examiner

VERTICALLY TRANSLATING HINGE MECHANISM FOR A BUILT-IN OVEN

FIELD OF THE DEVICE

The device is in the field of heating appliances, more specifically, a vertically translating hinge mechanism for a door panel of the heating appliance.

SUMMARY

In at least one aspect, a heating appliance includes an appliance cabinet having a plurality of sidewalls that define a heating cavity. A door is operably connected to at least one of the sidewalls and operable between open and closed positions. A vertical translating assembly extends from the appliance cabinet to the door. The vertical translating assembly includes drive and offset arms and a power assist mechanism in operable communication with the drive arm. The power assist mechanism at least partially operates the door between the open and closed positions.

In at least another aspect, a heating appliance includes an appliance cabinet defining a heating cavity. Upper and lower door panels are operably connected to the appliance cabinet. The upper and lower door panels are operable to define a closed position, where the upper and lower door panels enclose the heating cavity. The upper and lower door panels are also operable to define an open position, wherein the upper and lower door panels are vertically translated in opposite directions from one another and are distal from the heating cavity. A vertical translating assembly extends from the appliance cabinet to each of the upper and lower door panels. The vertical translating assembly includes an upper translation mechanism attached to the upper door panel and a lower translation mechanism attached to the lower door panel. The vertical translating assembly defines simultaneous operation of the upper and lower translation mechanisms such that operation of one of the upper and lower door panels operates both of the upper and lower door panels between the open and closed positions.

In at least another aspect, a vertically-translating, door-operating assembly includes upper and lower door panels operably connected to respective door plates. The upper and lower door panels are operable to define a closed position, wherein a bottom side of the top door panel engages the top side of the bottom door panel, and an open position, wherein the upper and lower door panels are vertically translated in opposite directions from one another. An upper translation mechanism is attached to the upper door panel. A lower translation mechanism is coupled to the lower door panel, wherein operation of one of the upper and lower door panels defines simultaneous operation of both of the upper and lower door panels between the open and closed positions.

These and other features, advantages, and objects of the present device will be further understood and appreciated by those skilled in the art upon studying the following specification, claims, and appended drawings.

DETAILED DESCRIPTION OF EMBODIMENTS

Figure 1:
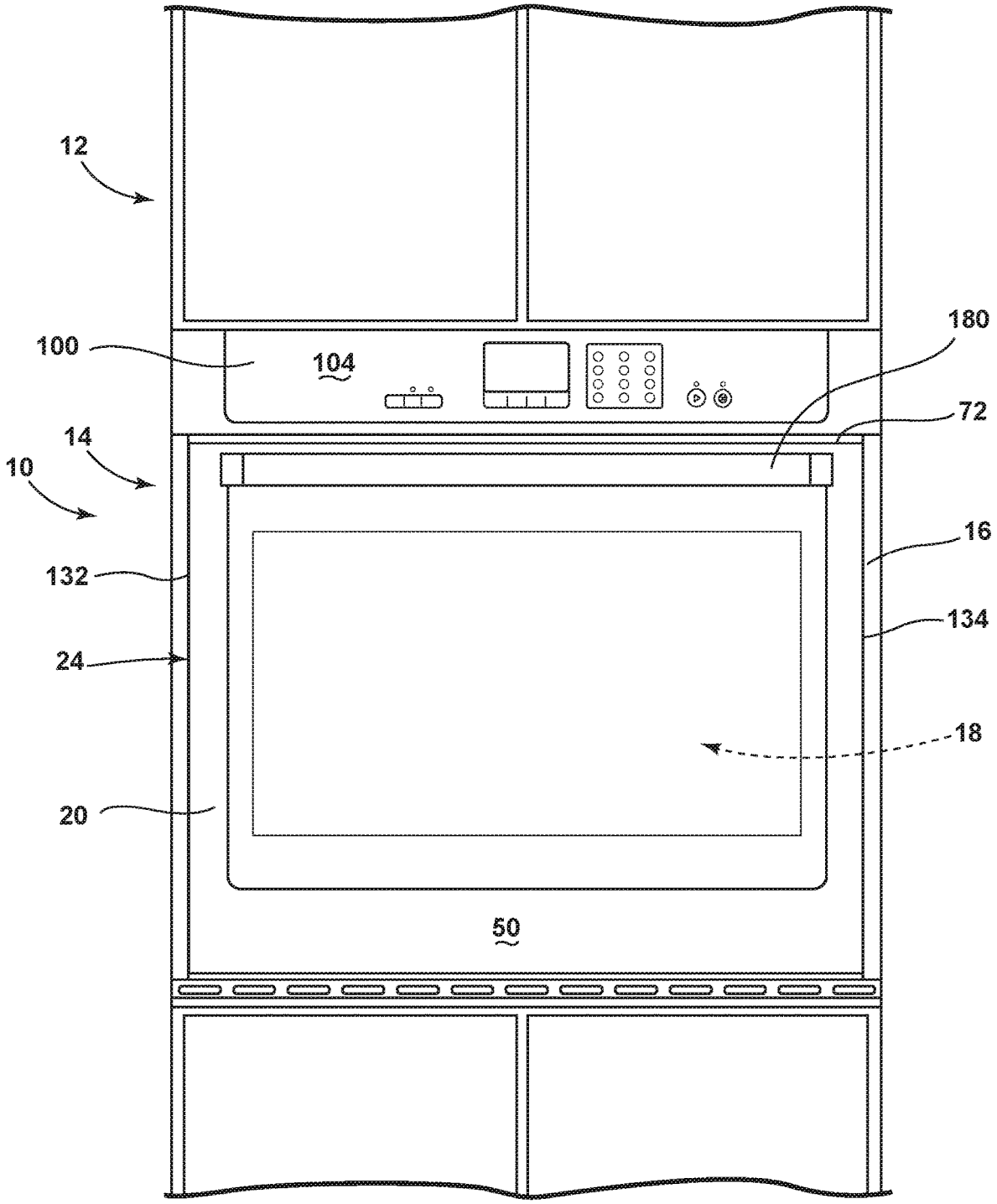
FIG. 1 is a front elevational view of a built-in heating appliance having a single vertically translating door panel illustrated in a closed position.
Figure 2:
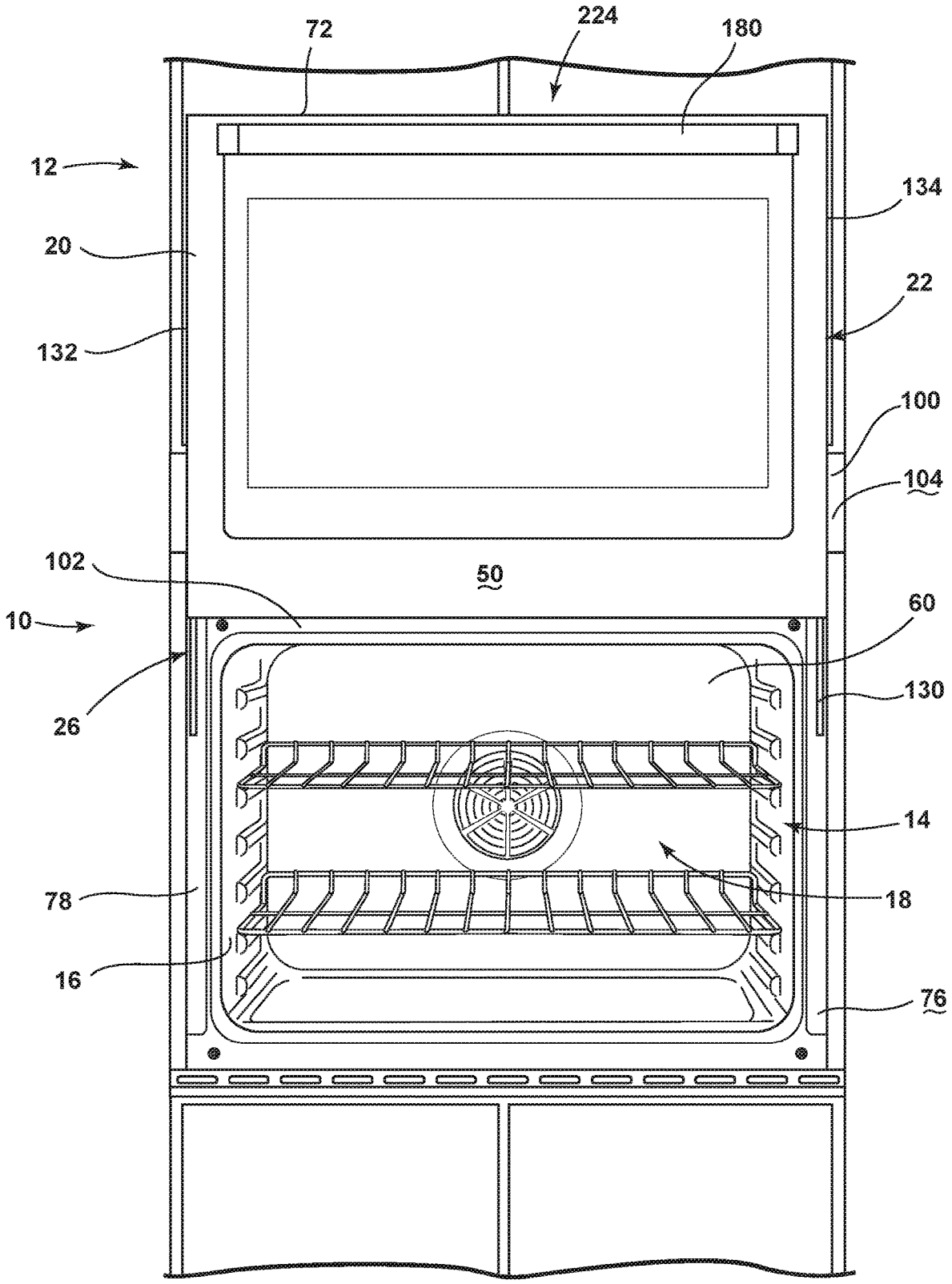
FIG. 2 is a front elevational view of the heating appliance of FIG. 1 with the vertically translating door panel in an open position.
Figure 3:
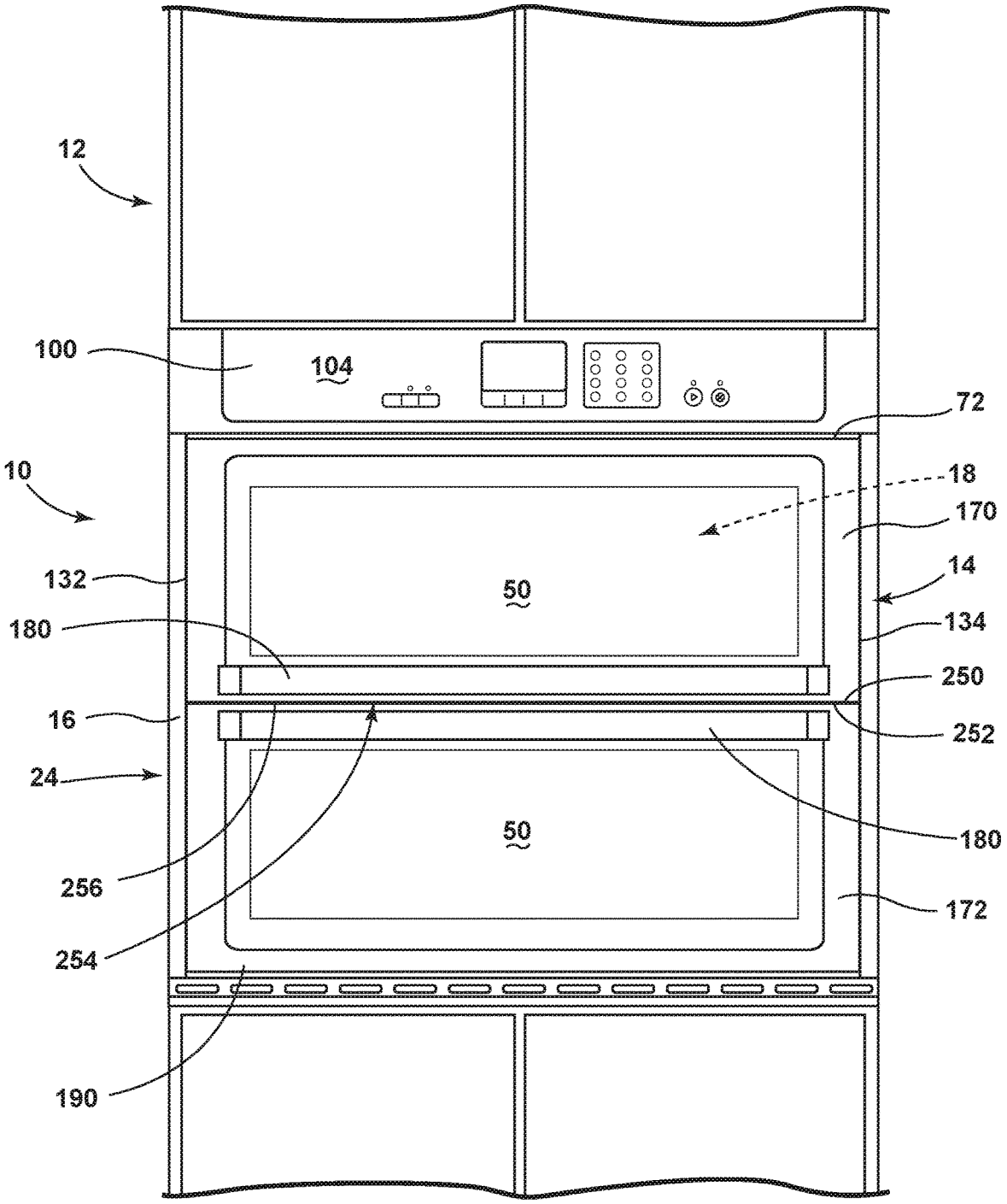
FIG. 3 is a front elevational view of a built-in heating appliance having upper and lower vertically translating door panels illustrated in a closed position.
Figure 4:
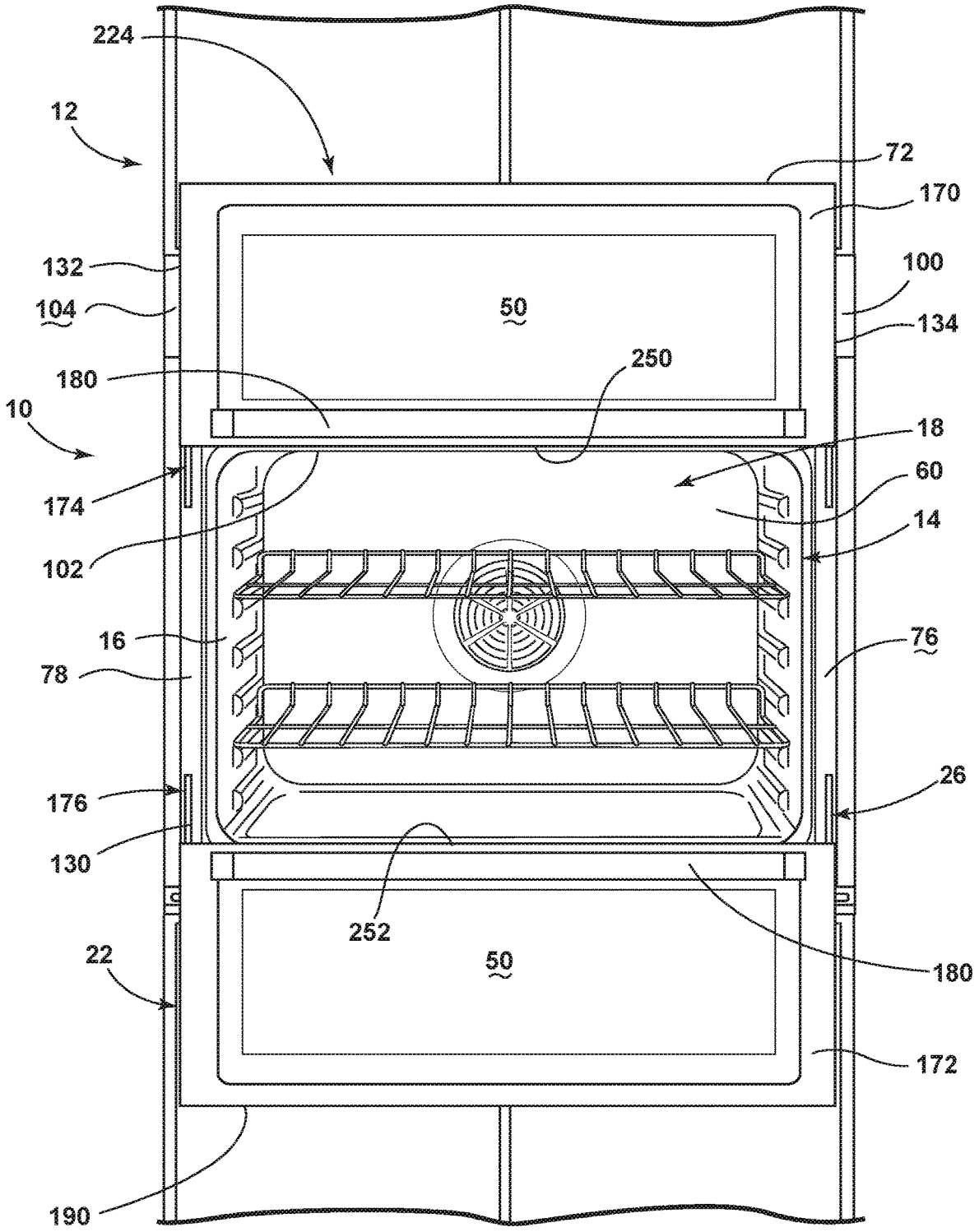
FIG. 4 is a front elevational view of the heating appliance of FIG. 3 with the upper and lower vertically translating door panels in an open position.
Figure 5:
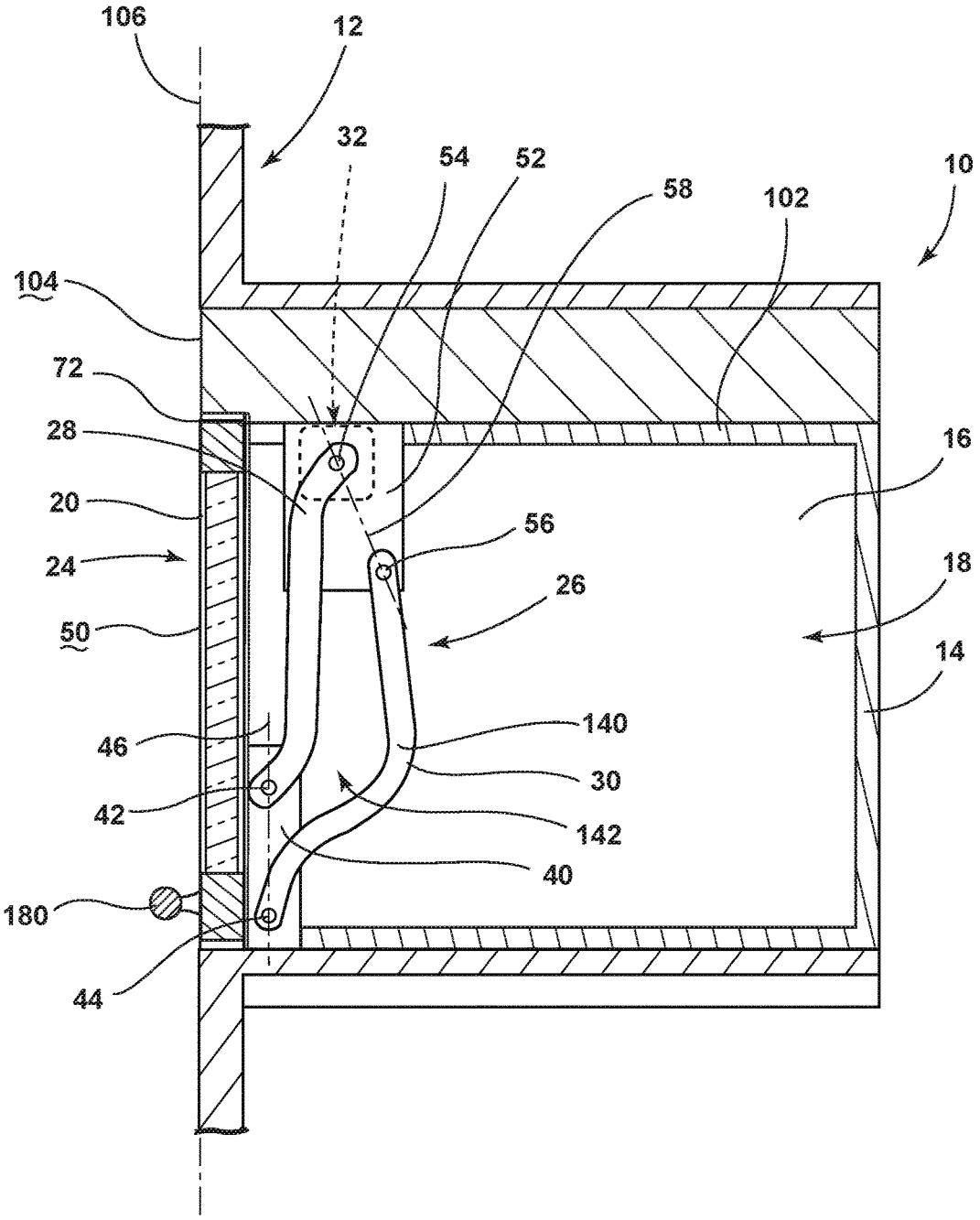
FIG. 5 is a cross-sectional view of the heating appliance of FIG. 1 taken along line V-V.
Figure 6:
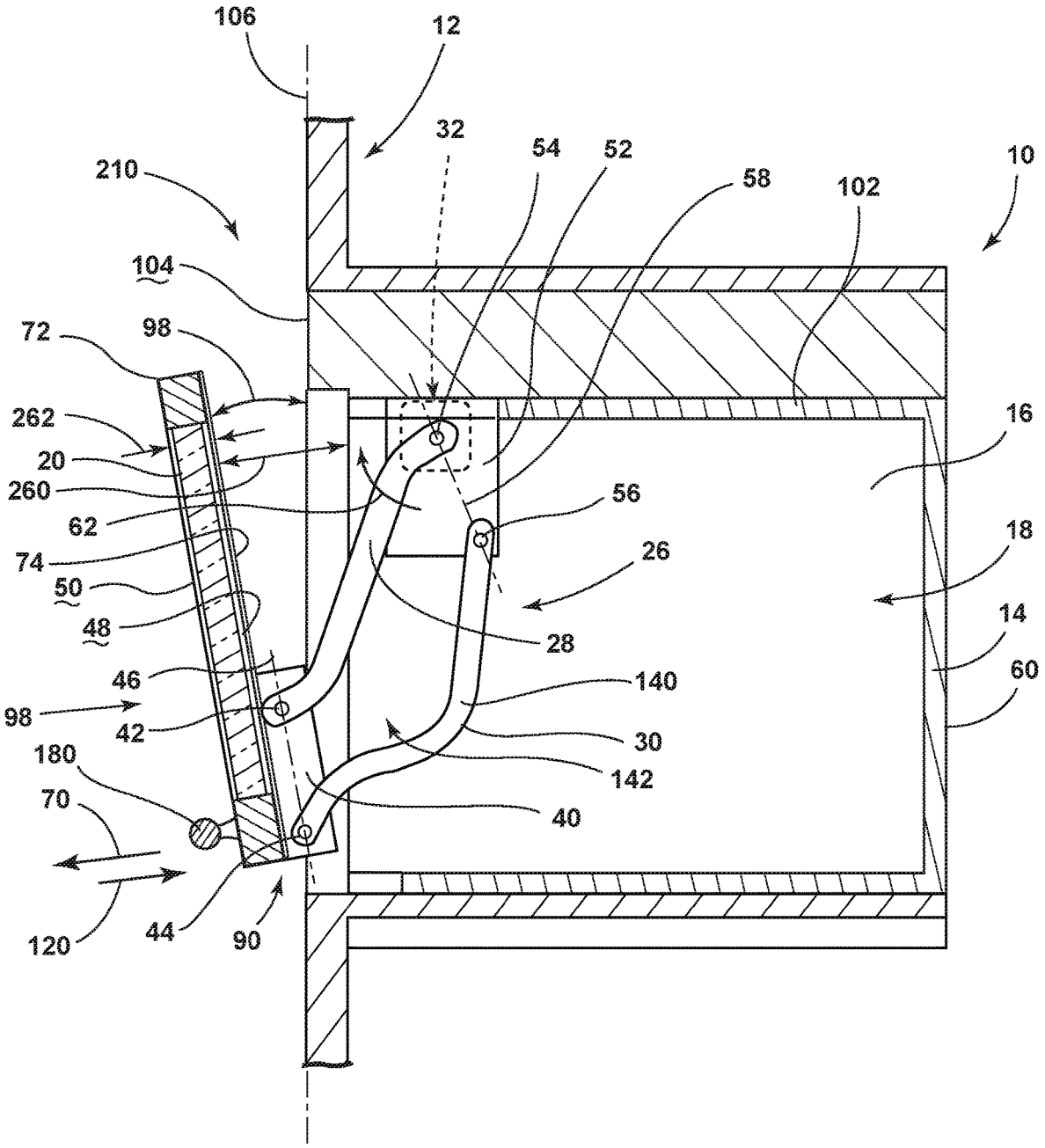
FIG. 6 is a cross-sectional view of the heating appliance of FIG. 5 illustrating the movement of the vertically translating door panel from the closed position to an offset position.
Figure 7:
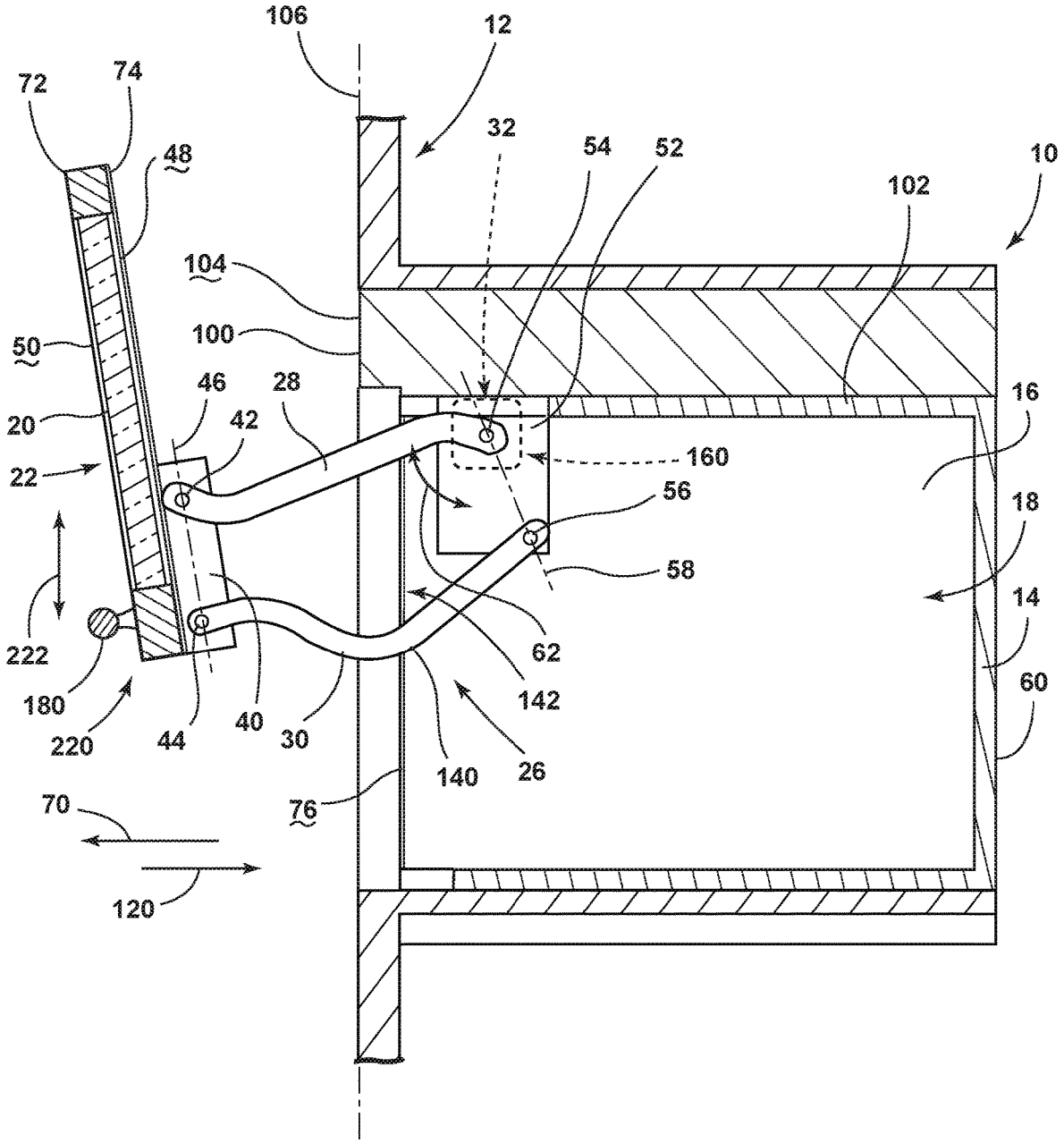
FIG. 7 is a cross-sectional view of the heating appliance of FIG. 6 showing the vertical movement of the vertically translating door panel toward the open position.
Figure 8:
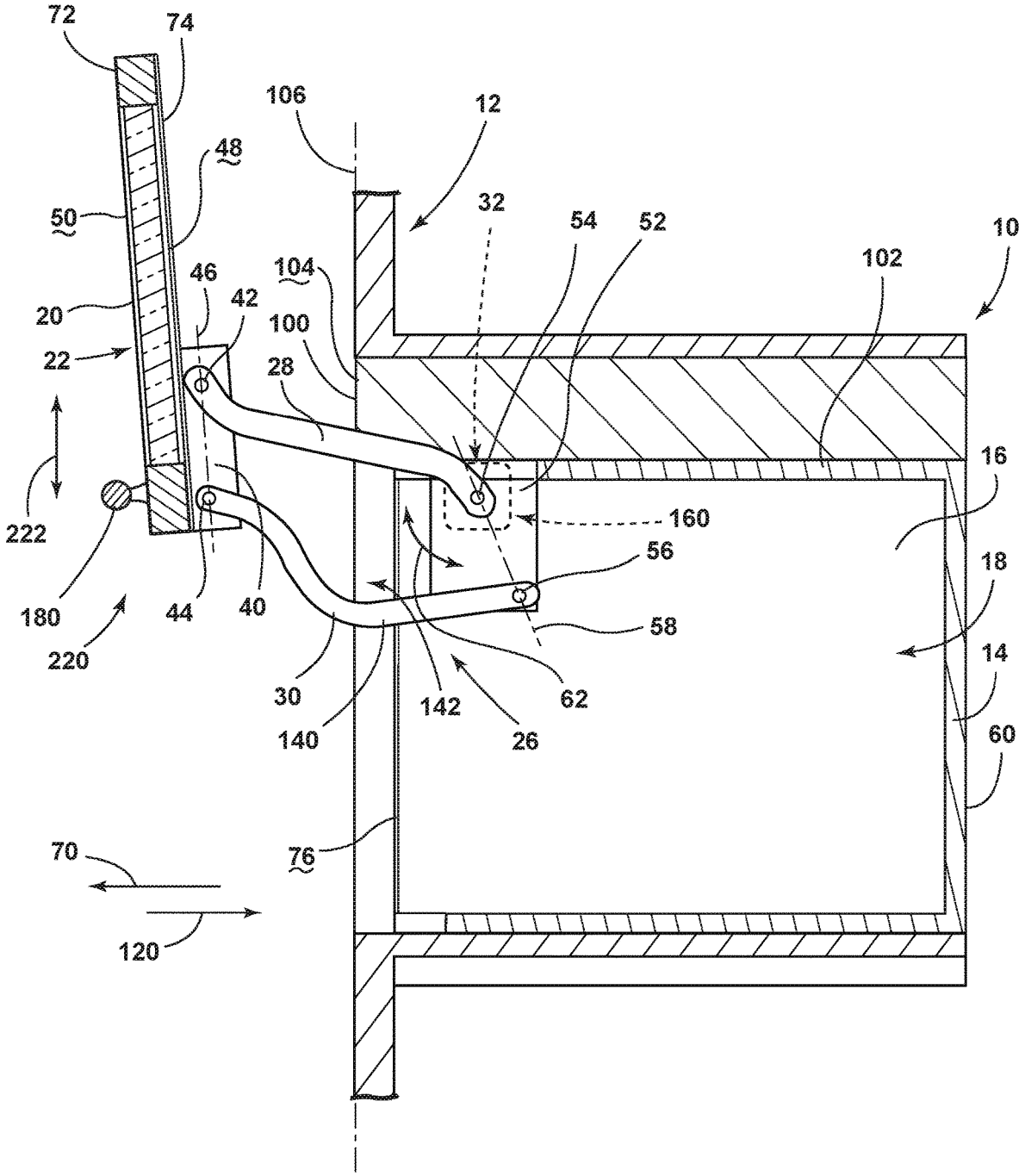
FIG. 8 is a cross-sectional view of the heating appliance of FIG. 6 showing the vertical movement of the vertically translating door panel toward the open position.
Figure 9:
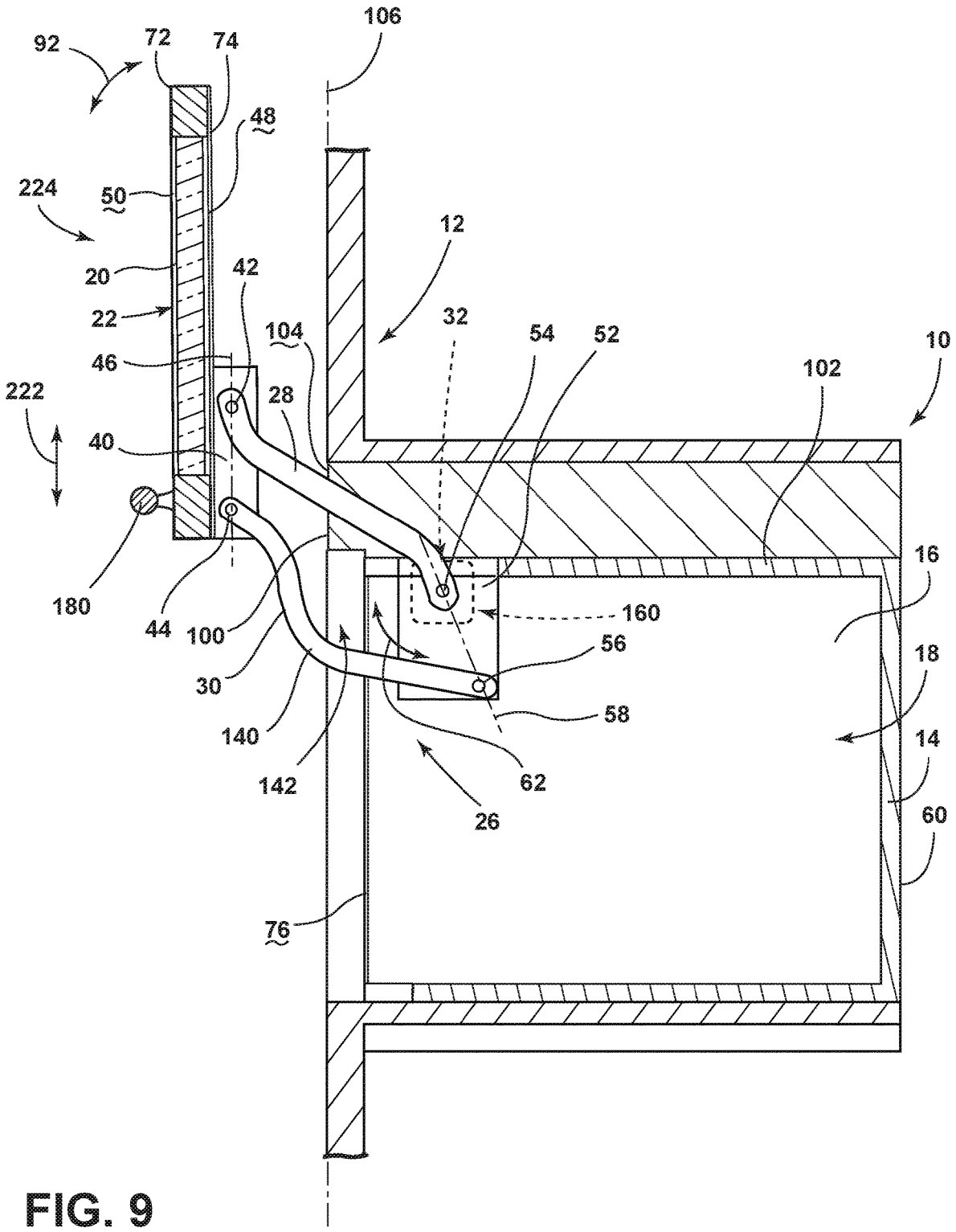
FIG. 9 is a cross-sectional view of the heating appliance of FIG. 5 illustrating the vertically translating door panel in the fully-open position.
Figure 10:
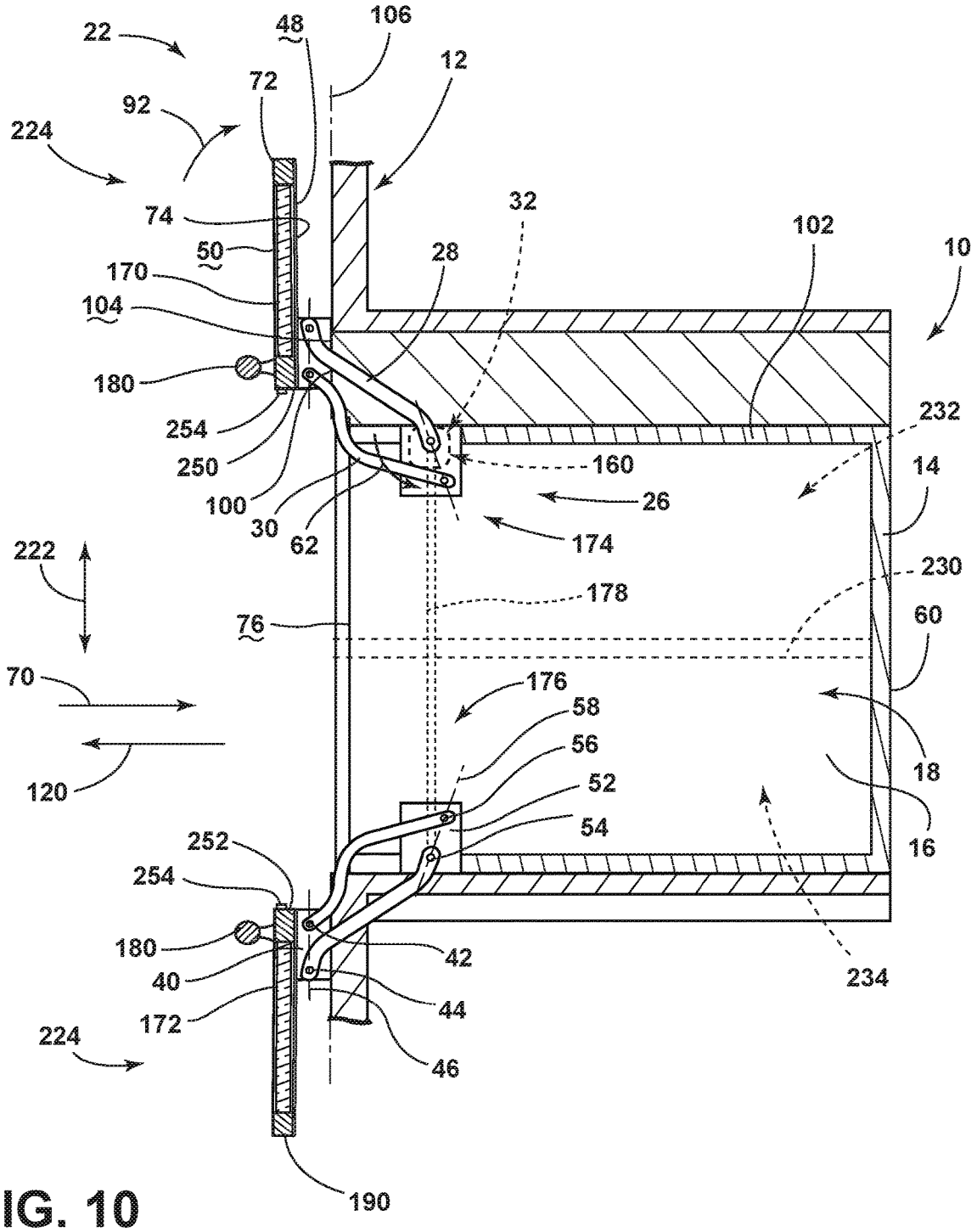
FIG. 10 is a cross-sectional view of the heating appliance of FIG. 4 taken along line X-X.
Figure 11:
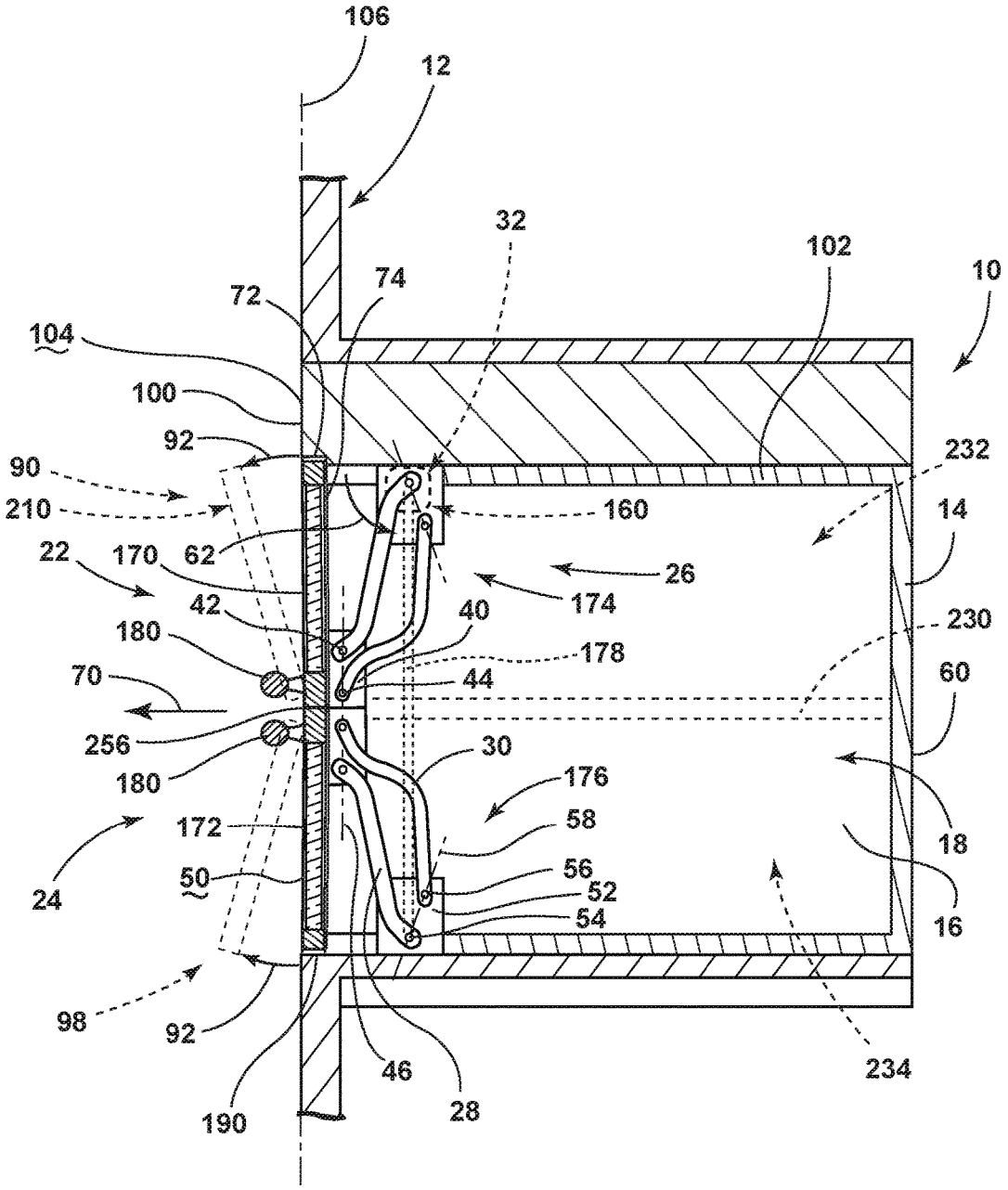
FIG. 11 is a cross-sectional view of the heating appliance of FIG. 10 showing the upper and lower vertically translating door panels in a closed position.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

As illustrated in FIGS. 1-2 and 5-9, reference numeral 10 generally refers to a built-in heating appliance for installation within a wall or cabinet structure 12. The heating appliance 10 can include an appliance cabinet 14 having a plurality of sidewalls 16 that define a heating cavity 18. A door 20 is operably connected to at least one of the sidewalls 16 and is operable between open and closed positions 22, 24. A vertical translating assembly 26 extends from the appliance cabinet 14 to the door 20. The vertical translating assembly 26 includes drive and offset arms 28, 30 and a power assist mechanism 32 that is in operable communication with the drive arm 28. It is contemplated that the power assist mechanism 32 at least partially operates the door 20 between the open and closed positions 22, 24. In this manner, this power assist mechanism 32 can be fully automatic such that the power assist mechanism 32 fully operates the doors between the open and closed positions 22, 24. Alternatively, the power assist mechanism 32 can provide a portion of the force necessary for operating the door 20 between the open and closed positions 22, 24 such that the power assist mechanism 32, in conjunction with the effort of the user of the heating appliance 10 operates the door 20 between the open and closed positions 22, 24.

Referring again to FIGS. 1, 2 and 5-9, the vertical translating assembly 26 can include a door plate 40 that is attached to the door 20, where the door plate 40 includes an outer drive pivot 42 and an outer offset pivot 44. It is contemplated that the outer drive and outer offset pivots 42, 44 are positioned along a vertical axis 46 of the door plate 40. The vertical axis 46 of the door plate 40 can be generally parallel with inner and outer door surfaces 48, 50 of the door 20 for the heating appliance 10. The vertical translating assembly 26 can also include a cabinet plate 52 that is attached to the cabinet 14 of the heating appliance 10. The cabinet plate 52 can include an inner drive pivot 54 and an inner offset pivot 54, wherein the inner drive pivot 54 and inner offset pivot 54 are positioned at an offset angle 58. It is contemplated that the offset angle 58 is an oblique angle with respect to the back wall 60 of the cabinet 14. According to the various embodiments, the inner offset pivot 54 can be positioned farther from the door 20 than the inner drive pivot 54. Additionally, it is contemplated that the power assist mechanism 32 can be coupled to the inner drive pivot 54 such that the power assist mechanism 32 exerts a rotational force 62 through the vertical translating assembly 26 and to the door 20 via the inner drive pivot 54, the drive arm 28, the outer drive pivot 42 and into the door plate 40 of the vertical translating assembly 26.

Referring again to FIGS. 1, 2 and 5-9, it is contemplated that movement of the door 20 from the closed position 24 defines an initial outward movement 70 of a top edge 72 of the door 20 away from the cabinet 14. It is contemplated that this outward movement 70 partially disengages a seal 74 of the door 20 from a contact surface 76 of the cabinet 14. It is contemplated that the contact surface 76 of the cabinet 14 is defined by a front edge 78 of the plurality of sidewalls 16 that form the cabinet 14. In this manner, the seal 74 of the door 20 is adapted to engage the contact surface 76 of the cabinet 14 to provide a sealing engagement between the door 20 and cabinet 14 when the door 20 is in the closed position 24. According to various embodiments, an adhesive force can exist between the seal 74 of the door 20 and the contact surface 76 when the door 20 is in the closed position 24. Accordingly, separating the door 20 and seal 74 from the contact surface 76 can be more efficiently accomplished when a minimal rotation of the door 20 separates an edge of the door 20 from the contact surface 76. In this manner, the movement of the door 20 away from the closed position 24 is defined by an outward movement 70 of the top edge 72 of the door 20 that defines a bypassing motion 90 of the door 20 in front of a vertical exterior plane 106. This outward movement 70 is combined with a minimal rotational movement 92 of the top edge 72 of the door 20 about the outer offset pivot 44. To accomplish this bypassing motion 90 of the door 20, a gap can be defined between the top edge 72 of the door and the control panel 100. This gap provides a clearance within which the combined outward movement 70 and rotational movement 92 of the top edge 72 of the door 20 can be performed.

According to the various embodiments, as exemplified in FIGS. 1-11, the heating appliance 10 can include a control panel 100 that is positioned proximate a top wall 102 of the cabinet 14. When the door 20 is in the closed position 24, a control panel surface 104 is positioned above the outer door surface 50 and the control panel 100 and outer door surfaces 50 define the vertical exterior plane 106 of the heating appliance 10. The bypassing motion 90 defined by the combined rotational movement 92 and outward movement 70 of the top edge 72 of the door 20 serves to laterally displace the door 20 away from the cabinet 14 such that movement of the door 20 toward the open position 22 vertically translates the door 20 in front of the control panel 100. In this manner, the outward movement 70 of the door 20 moves the inner door surface 48 of the door 20 in front of the control panel surface 104, such that as the door 20 is moved to the open position 22, the door 20 vertically translates in front of the vertical exterior plane 106 of the heating appliance 10.

Referring again to FIGS. 5-9, when the door 20 is moved back into the closed position 24, the movement of the door 20 defines a combined rotational movement 92 and inward movement 120 of the top edge 72 of the door 20 toward the contact surface 76. These rotational and inward movements 92, 120 serve to engage the seal 74 of the door 20 with the contact surface 76 of the cabinet 14. Accordingly, the rotational and inward movements 92, 120 of the door 20 define the bypassing motion 90 of the door 20 from an offset position 98 in front of the control panel surface 104 back into the closed position 24 and in alignment with the control panel 100. As discussed above, in the closed position 24, the outer door surface 50 is in alignment with the vertical exterior plane 106 of the heating appliance 10.

Referring again to FIGS. 1-11, the drive arm 28 and offset arm 30 of the vertical translating assembly 26 are configured to operate within a common vertical plane. Accordingly, it is contemplated that the drive arm 28 and the offset arm 30 are substantially unable to cross paths with one another during operation of the door 20 between the open and closed positions 22, 24. Accordingly, the drive arm 28 and offset arm 30, in this configuration, can occupy a minimal amount of space. It is contemplated that this minimal amount of space can be positioned within a wall cavity of at least one of the plurality of sidewalls 16 that define the cabinet 14. In such an embodiment, the sidewall within which the drive and offset arms 28, 30 are disposed can include an exterior slot 130 defined proximate the contact surface 76 of the cabinet 14. The drive and offset arms 28, 30 can protrude from the exterior slot 130 such that the drive and offset arms 28, 30 can move through the slot 130 as the vertical translating assembly 26 operates the door 20 between the open and closed positions 22, 24. It is also contemplated that the drive and offset arms 28, 30, as well as the cabinet plate 52, are each positioned outside of the heating cavity 18 and outside of the various sidewalls 16 of the cabinet 14. It is also contemplated that the cabinet plate 52, drive arm 28 and offset arm 30 of the vertical translating assembly 26 are positioned within the heating cavity 18. It is further contemplated that the vertical translating assembly 26 can include a drive arm 28 and offset arm 30 on each of the right side 132 and left side 134 of the door 20.

Referring again to FIGS. 5-11, the offset arm 30 can include a bent portion 140 that defines an offset region 142 of the offset arm 30. During operation of the door 20 between the open and closed positions 22, 24, the inner drive pivot 54 can be positioned within the offset region 142 when the door 20 is in the closed position 24. It is also contemplated that the outer drive pivot 42 can be positioned within the offset region 142 when the door 20 is in the open position 22. In this manner, the offset region 142 defined within the bent portion 140 of the offset arm 30 can allow for operation of the vertical translating assembly 26 with the drive and offset arms 28, 30 occupying the common vertical plane, while avoiding collision of the drive and offset arms 28, 30 during operation.

Referring again to FIGS. 5-11, the bypassing motion 90 of the door 20 as it moves away from or toward the closed position 24 can be generated by the configuration of the inner drive pivot 54 and inner offset pivot 54 at the offset angle 58, in cooperation with the alignment of the outer drive pivot 42 and outer offset pivot 44 within the vertical axis 46 of the door plate 40. The oblique orientation of the inner drive pivot 54 and inner offset pivot 54 at the offset angle 58 serves to generate the outward movement 70 of the top edge 72 of the door 20, as the door 20 leaves, and also moves into, the closed position 24. Accordingly, when the door 20 is in the closed position 24, the outer door surface 50 can be in alignment or substantially in alignment with the control panel surface 104 such that the door 20 and control panel 100 of the heating appliance 10 define a single and continuous vertical exterior plane 106. It is contemplated that this vertical exterior plane 106 can be substantially co-planar with the environment surrounding the heating appliance 10. Accordingly, the heating appliance 10 can be built into the wall or cabinet structure 12 such that the vertical exterior plane 106 of the heating appliance 10 can be co-planar or substantially co-planar with the surrounding areas of the wall or cabinet structure 12.

Referring again to FIGS. 5-11, the bypassing motion 90 of the door 20 as it moves away from and into the closed position 24 defines the lateral outward and inward movements 70, 120 of the door 20 such that the door 20 is in the offset position 98 offset from the vertical exterior plane 106 and also from the control panel 100. Accordingly, after the bypassing motion 90 of the door 20 is performed, the vertical translating motion of the door 20 can be accomplished such that the door 20 can vertically translate in front of the control panel 100, and also in front of portions of the wall or cabinet structure 12 surrounding the heating appliance 10. This vertical translating motion of the door 20 provides for minimal outward movement 70 of the door 20 between the open and closed positions 22, 24. In this manner, a user of the heating appliance 10 can stand immediately in front of the heating cavity 18 to place items within or remove items from the heating cavity 18.

Within conventional appliances, the door is typically rotationally operable such that the door rotates downward around a conventional hinge. When the door is rotated downward, the space in front of the conventional appliance is occupied by the door in the open position, such that a user of the appliance needs to stand away from the heating cavity and reach over the horizontally positioned door to access the interior of the conventional appliance. In this position, the inner surface of the door faces upward. The user must reach over the potentially heated inner surface of the door in order to reach into the heating cavity of the conventional heating appliance. Alternatively, the user can stand next to the door in the open position for accessing the interior of the appliance. Both conditions are less than optimal and require the user to reach over the horizontally oriented open door for accessing the appliance.

Referring again to FIGS. 5-9, the vertical translating assembly 26 of the heating appliance 10 provides for vertical translation of the door 20 to the open position 22. As such, the user can stand in front of the heating appliance 10 and directly access the heating cavity 18 without having to reach over the inner door surface 48 of the door 20. Additionally, the inner door surface 48 of the door 20 after being vertically translated to define an open position 22 is placed in close proximity with and faces the control panel 100 and the areas surrounding the heating appliance 10. Accordingly, the inner door surface 48, which can be heated to a high temperature from defining a portion of the heating cavity 18, is substantially shielded from access by the user such that it is less likely that a user will inadvertently touch the inner door surface 48 of the door 20 when accessing the heating cavity 18 of the heating appliance 10.

Referring again to FIGS. 5-11, it is contemplated that the power assist mechanism 32 can be contained within a housing 160 disposed proximate the cabinet plate 52. According to the various embodiments, the power assist mechanism 32 can include various power assist features that can include, but are not limited to, hydraulic rotating assemblies, pneumatic rotating assemblies, motors, spring-type biasing mechanisms, combinations thereof, and other similar power assist mechanisms 32. It is contemplated that the power assist mechanism 32 can also be disposed proximate the door plate 40 of the vertical translating assembly 26.

Referring now to FIGS. 3-11, according to various embodiments, the door 20 of the heating appliance 10 can include upper and lower door panels 170, 172, wherein the vertical translating assembly 26 includes an upper translating assembly 174 operably coupled to the upper door panel 170 and a lower translating assembly 176 operably coupled to the lower door panel 172. In such an embodiment, the closed position 24 is defined by the upper and lower door panels 170, 172 being in contact with the contact surface 76 to enclose the heating cavity 18. The upper and lower door panels 170, 172 are moved to the open position 22 such that the upper and lower door panels 170, 172 vertically operate in opposing directions away from the heating cavity 18 to define an open position 22. It is further contemplated that the upper and lower translating assemblies 174, 176 are connected or linked. In this manner, operation of one of the upper and lower door panels 170, 172 simultaneously operates both of the upper and lower door panels 170, 172 between the open and closed positions 22, 24. Accordingly, a linkage 178 can extend between the upper and lower translating assemblies 174, 176 such that when a user grasps a handle 180 of one of the upper and lower door panels 170, 172 to move the upper or lower door panels 170, 172 between the open and closed positions 22, 24, the other of the upper and lower door panels 170, 172 automatically moves in a simultaneous and opposing motion to operate the upper and lower door panels 170, 172 between the open and closed positions 22, 24.

Referring again to FIGS. 3-11, where the heating appliance 10 includes the upper and lower door panels 170, 172, the bypassing motion 90 of the lower door panel 172 can be defined by the combined rotational movement 92 and lateral outward movement 70 of the bottom edge 190 of the lower door panel 172 away from the contact surface 76, such that the bypassing motion 90 of the lower door panel 172 moves the lower door panel 172 to the offset position 98 and in front of a portion of the wall or cabinet structure 12 below the heating appliance 10. Accordingly, the lower door panel 172 can vertically translate in a generally downward direction and in front of the wall or cabinet structure 12 below the heating cavity 18. Where the upper and lower door panels 170, 172 and the upper and lower translation mechanisms are included within the heating appliance 10, the power assist mechanism 32 can be disposed within one or both of the upper and lower translation mechanisms. As discussed above, the linkage 178 extending between the upper and lower translation mechanisms serves to deliver at least a portion of the rotational force 62 from the power assist mechanism 32 to both of the upper and lower translation mechanisms. To accomplish this bypassing motion 90 of the upper and lower door panels 170, 172, gaps can be defined between the top edge 72 of the upper door panel 170 and the control panel 100 and between the bottom edge 190 of the lower door panel 172 and the cabinet structure 12. These gaps provide clearance within which the combined outward movement 70 and rotational movement 92 of the top and bottom edges 72, 190 of the upper and lower door panels 170, 172, respectively, can be performed.

According to the various embodiments, it is contemplated that the various gap or gaps can have a height in a range of from approximately 16 millimeters to approximately 18 millimeters, although gap heights greater or lesser than these distances are also contemplated. The height of the various gaps can be dependent upon the thicknesses of the various door or doors 20 of the heating appliance 10. The door 20 and/or the upper and lower door panels 170, 172 can have thicknesses (corresponding to the second distance 262 described below) in a range of from approximately 3.5 centimeters to approximately 5 centimeters. Other door 20 thicknesses greater than and/or less than this range are also contemplated, depending on the design of the heating appliance 10.

Referring again to FIGS. 3-11, operation of the upper and lower door panels 170, 172 between the open and closed positions 22, 24 defines a lateral translation portion 210 proximate the closed position 24. The vertical translating assembly 26 operating within the lateral translation portion 210 defines a primarily lateral outward/inward movement 70, 120 of the upper and lower door panels 170, 172 relative to the appliance cabinet 14 between the closed position 24 and the offset position 98. It is contemplated that the offset position 98 can be defined by the rear surfaces or inner door surfaces 48 of the upper and lower door panels 170, 172 being laterally translated in front of a control panel 100 of the appliance cabinet 14. This lateral outward movement 70 of the upper and lower door panels 170, 172 serves to place the inner door surfaces 48 of the upper and lower door panels 170, 172 in front of the control panel surface 104 as well as the vertical exterior plane 106 of the heating appliance 10. As discussed above, the control panel surface 104 and the front surfaces or outer door surfaces 50 of the upper and lower door panels 170, 172 are at least partially coplanar when the upper and lower door panels 170, 172 are in the closed position 24. Accordingly, the control panel surface 104 and the outer door surfaces 50 define the vertical exterior plane 106 of the heating appliance 10. It is contemplated that the lateral translation portion 210 of the vertical translating assembly 26 can be the area of operation of the upper and lower door panels 170, 172 into the closed position 24 and out of the closed position 24. Accordingly, the lateral translation portion 210 of the vertical translating assembly 26 can correspond to the bypassing motion 90 of the upper and lower door panels 170, 172.

Referring again to FIGS. 3-11, it is contemplated that operation of the upper and lower door panels 170, 172 between the open and closed positions 22, 24 can further define a vertical translation portion 220. In such an embodiment, the vertical translating assembly 26, when moving through the vertical translating portion defines a primary vertical movement 222 of the upper and lower door panels 170, 172 relative to the heating appliance 10 between the offset position 98 and a fully-opened position 224. As discussed above, the lateral translation portion 210 of the vertical translating assembly 26 serves to generate the bypassing motion 90 to place the upper and lower door panels 170, 172 in front of the control panel 100 and the surrounding wall and cabinet structure 12 around the heating appliance 10. This bypassing motion 90 places the upper and lower door panels 170, 172 in the offset position 98 and able to be vertically translated within the vertical translation portion 220 to move the upper and lower door panels 170, 172 away from the heating cavity 18, so that the heating cavity 18 can be accessed by the user.

Referring again to FIGS. 3, 4 and 10-11, where the upper and lower door panels 170, 172 are included within the heating appliance 10, the heating cavity 18 can define a single continuous volume. It is also contemplated that a central mullion 230 can be positioned within a heating cavity 18 such that the upper door panel 170 corresponds to an upper heating cavity 232 and a lower door panel 172 corresponds to a lower heating cavity 234. It is further contemplated that the central mullion 230 can be a selectively removable member such that the single continuous heating cavity 18 can be selectively separated into individual upper and lower heating cavities 232, 234 when desired by the user.

According to the various embodiments, it is contemplated that the heating appliance 10 can include a plurality of heating cavities 18, each with a corresponding door 20. Accordingly, each of the multiple heating cavities 18 can have a dedicated door 20 that is operable through the use of a dedicated vertical translating assembly 26. The various vertical translating assemblies 26 may be connected via the linkage 178 or can be separately operable. In this manner, the vertical translating assembly can be implemented in cooking appliances 10 having one, two, three or more separate heating cavities 18.

Referring again to FIGS. 1-11, according to the various embodiments, the vertical translating assembly 26 can include upper and lower door panels 170, 172 that are operably connected to respective door plates 40. In such an embodiment, the upper and lower door panels 170, 172 are operable to define a closed position 24, wherein a bottom side 250 of the top door panel engages the top side 252 of the lower door panel 172. It is contemplated that a lateral seal 254 can be defined between the bottom side 250 of the upper door panel 170 and the top side 252 of the lower door panel 172 such that a seam 256 between the upper and lower door panels 170, 172 can define a sealing engagement that substantially limits the amount of heat that may escape through the seam 256 during use of the heating appliance 10 and when the upper and lower door panels 170, 172 are in the closed position 24. It is contemplated that the upper and lower door panels 170, 172 are capable of being vertically translated in opposite directions from one another to define an open position 22. Accordingly, an upper translation mechanism is attached to the upper door panel 170 and a lower translation mechanism is coupled to the lower door panel 172. It is also contemplated that the operation of one of the upper and lower door panels 170, 172 defines simultaneous operation of both the upper and lower door panels 170, 172 between the open and closed positions 22, 24.

Referring again to FIGS. 1-11, it is contemplated that operation of the upper and lower door panels 170, 172 between the open and closed positions 22, 24 defines the lateral translation portion 210 proximate the closed position 24. As discussed above, the vertical translating assembly 26 operating within the lateral translation portion 210 defines a primarily lateral outward/inward movement 70, 120 of the upper and lower door panels 170, 172 relative to the respective cabinet plates 52 of the upper and lower translation mechanisms. As discussed above, the lateral translation portion 210 of the vertical translating assembly 26 operates the upper and lower door panels 170, 172 between the closed position 24 and the offset position 98. The offset position 98 is defined by the rear surfaces or the inner door surfaces 48 of the upper and lower door panels 170, 172 being laterally translated the first distance 260, wherein the first distance 260 is greater than a second distance 262 defined by a thickness of the upper door panel 170. Accordingly, the offset position 98 places the entire thickness of the upper door panel 170 in front of a control panel 100 disposed above the cavity of the heating appliance 10.

Referring again to FIGS. 1-11, operation of the upper and lower door panels 170, 172 between the open and closed positions 22, 24 further defines the vertical translating portion, wherein the vertical translating assembly 26 operating within the vertical translating portion defines a primarily vertical movement 222 of the upper and lower door panels 170, 172, in opposing directions relative to the cabinet plate 52 between the offset position 98 and a fully-opened position 224.

According to various embodiments, the vertical translating assembly 26 of the heating appliance 10 can also be applied to various other appliances than can include, but are not limited to, refrigerating appliances, ovens, toaster ovens, dishwashers, laundry appliances, and other similar household and commercial appliances having doors 20 that enclose and provide access to an interior chamber.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A heating appliance comprising:

an appliance cabinet having a plurality of sidewalls that define a heating cavity;

a door panel operably connected to at least one sidewall of the plurality of sidewalls and operable via a rotational movement between open and closed positions; and a vertical translating assembly extending from the appliance cabinet to the door panel, wherein the vertical translating assembly includes drive and offset arms and a power assist mechanism in operable communication with the drive arm, and wherein the power assist mechanism at least partially operates the door panel between the open and closed positions, wherein a front surface of the appliance cabinet extending around at least three edges of the door panel and a front surface of the door panel are co-planar when the door panel is in the closed position, and wherein the door panel is generally vertical in each of the open and closed positions, and wherein the vertical translating assembly operates the door panel through a continuous arcuate path relative to the appliance cabinet between the open and closed positions.

2. The heating appliance of claim 1, wherein the door panel includes upper and lower door panels and wherein the vertical translating assembly includes an upper translation mechanism operably coupled to the upper door panel and a lower translation mechanism operably coupled to the lower door panel, wherein the closed position is defined by the upper and lower door panels enclosing the heating cavity, and wherein the upper and lower door panels vertically operate in opposing directions away from the heating cavity to define the open position, wherein the open position is defined by the upper door panel being entirely above the heating cavity and the lower door panel being entirely below the heating cavity.

3. The heating appliance of claim 2, wherein the upper and lower translation mechanisms of the vertical translating assembly are connected such that operation of one of the upper and lower door panels simultaneously operates both of the upper and lower door panels between the open and closed positions.

4. The heating appliance of claim 1, wherein the vertical translating assembly includes a door plate attached to the door panel and having an outer drive pivot and an outer offset pivot, wherein the outer drive and outer offset pivots are positioned along a vertical axis of the door plate.

5. The heating appliance of claim 4, wherein the vertical translating assembly includes a cabinet plate attached to the appliance cabinet and having an inner drive pivot and an inner offset pivot, wherein the inner drive and inner offset pivots are positioned at an offset angle, wherein the offset angle is oblique with respect to a back wall, and wherein each of the inner drive pivot and the inner offset pivot are laterally aligned with the heating cavity.

6. The heating appliance of claim 5, wherein movement of the door panel from the closed position defines an outward movement of a top edge of the door panel away from the appliance cabinet, wherein the outward movement partially disengages a seal of the door panel from a contact surface of the appliance cabinet, and wherein movement of the door panel into the closed position defines an inward movement of the top edge of the door panel toward the contact surface, wherein the inward movement engages the seal with the contact surface.

7. The heating appliance of claim 6, further comprising:

a control panel positioned proximate a top wall of the appliance cabinet, wherein when the door panel is in the closed position, a control panel surface is positioned above the front surface of the door panel and the control panel surface and the front surface of the door panel define a vertical exterior plane, and wherein movement of the door panel away from the closed position defines the outward movement of the top edge of the door panel to define a bypassing motion of the door panel in front of the vertical exterior plane, wherein movement of the door panel toward the open position vertically translates the door panel in front of the control panel.

8. The heating appliance of claim 5, wherein the drive arm and the offset arm are operable within a common vertical plane, wherein the offset arm includes a bent portion that defines an offset region of the offset arm, where the inner drive pivot is positioned within the offset region when the door panel is in the closed position, and wherein the outer drive pivot is positioned within the offset region when the door panel is in the open position.

9. The heating appliance of claim 5, wherein the cabinet plate and drive and offset arms are each positioned outside of the heating cavity.

10. The heating appliance of claim 1, wherein the power assist mechanism is a hydraulic-based assembly.

11. A heating appliance comprising:

an appliance cabinet defining a heating cavity;

upper and lower door panels operably connected to the appliance cabinet, the upper and lower door panels operable to define a closed position, wherein the upper and lower door panels each have rear surfaces that enclose the heating cavity and front door surfaces that are flush with a front surface of the appliance cabinet that surrounds the upper and lower door panels on at least three sides of the upper and lower door panels, and an open position, wherein the upper and lower door panels are vertically translated via rotational movements and in opposite directions from one another and are distal from the heating cavity; and a vertical translating assembly extending from the appliance cabinet to each of the upper and lower door panels, wherein the vertical translating assembly includes an upper translation mechanism attached to the upper door panel and a lower translation mechanism coupled to the lower door panel, and wherein the vertical translating assembly defines simultaneous operation of the upper and lower translation mechanisms such that operation of one of the upper and lower door panels operates both of the upper and lower door panels between the open and closed positions, and wherein the upper and lower door panels are generally vertical in each of the open and closed positions, and wherein the upper and lower translation mechanisms operate the upper and lower door panels through respective continuous arcuate paths relative to the appliance cabinet.

12. The heating appliance of claim 11, wherein at least one of the upper and lower translation mechanisms includes a power assist mechanism that at least partially operates the upper and lower door panels between the open and closed positions.

13. The heating appliance of claim 12, wherein the power assist mechanism is a hydraulic-based assembly.

14. The heating appliance of claim 11, wherein operation of the upper and lower door panels between the open and closed positions defines a lateral translation portion proximate the closed position, wherein the vertical translating assembly in the lateral translation portion defines a primarily lateral movement of the upper and lower door panels relative to the appliance cabinet between the closed position and an offset position wherein the rear surfaces of the upper and lower door panels are laterally translated in front of a control panel of the appliance cabinet, wherein a control panel surface and the front door surfaces of the upper and lower door panels are at least partially co-planar when in the closed position.

15. The heating appliance of claim 14, wherein the operation of the upper and lower door panels between the open and closed positions further defines a vertical translation portion, wherein the vertical translating assembly in the vertical translation portion defines a primarily vertical movement of the upper and lower door panels relative to the appliance cabinet between the offset position and a fully-open position.

16. The heating appliance of claim 11, wherein the heating cavity defines a single continuous volume.

17. The heating appliance of claim 16, wherein each of the upper and lower door panels is attached to respective drive and offset arms of the vertical translating assembly, wherein the respective drive arms extend to corresponding inner drive pivots and the respective offset arms extend to corresponding inner offset pivots, and wherein the inner drive pivots and the inner offset pivots are attached to the appliance cabinet and are laterally aligned with the heating cavity.

* * * * *